US006834518B1

(12) United States Patent
Shih et al.

(10) Patent No.: US 6,834,518 B1
(45) Date of Patent: Dec. 28, 2004

(54) KNITTING PROCESS FOR FABRIC CURTAIN WITH TRIMMING

(76) Inventors: Chin-Chang Shih, No. 105, Sec. 3, Chieh Shou Rd. Lu Kang Township, Changhua (TW); Chin-Tien Huang, No. 1, Lane 360, Yung Au Erh Road, Lu Kang Township, Changhua (TW)

( * ) Notice: Subject to any disclaimer, the term of this patent is extended or adjusted under 35 U.S.C. 154(b) by 0 days.

(21) Appl. No.: 10/721,261

(22) Filed: Nov. 26, 2003

(51) Int. Cl.[7] ..... D04B 21/20
(52) U.S. Cl. ..... 66/195; 66/170
(58) Field of Search ..... 60/169 R, 170, 60/180, 190, 191, 192, 193, 194, 195; 28/147; 223/46; 428/4, 5, 28

(56) References Cited

U.S. PATENT DOCUMENTS

| | | | | | |
|---|---|---|---|---|---|
| 2,182,653 | A | * | 12/1939 | Boggero et al. | 66/193 |
| 2,294,305 | A | * | 8/1942 | Klahre | 28/145 |
| 3,258,942 | A | * | 7/1966 | Mednick | 66/193 |
| 3,653,230 | A | * | 4/1972 | Tosco | 66/85 R |
| 4,034,579 | A | * | 7/1977 | Tillon | 66/85 R |

* cited by examiner

*Primary Examiner*—Danny Worrell
(74) *Attorney, Agent, or Firm*—Rabin & Berdo, P.C.

(57) ABSTRACT

A knitting process for a fabric curtain integrated with a trimming, is constructed in a given length using a knitting machine with preset numbers of warp and weft characterized by having the cable stitch pattern below a section of fabric in a given length to facilitate the knitting process to give better quality and additional value to the merchandise.

3 Claims, 6 Drawing Sheets

KNITTING PROCESS FOR FABRIC CURTAIN WITH TRIMMING

BACKGROUND OF THE INVENTION (a) Field of the Invention

The present invention is related to a knitting process for a fabric curtain with trimming, and more particularly, to a fabric curtain including door curtain, window curtain and tablecloth with a trimming giving additional value of the merchandise.

(b) Description of the Prior Art

Usually, fabric (including mesh fabric) or shutters are generally available in the market for keeping off the sunlight. However, for the fabric curtain, it is usually available in a whole piece of fabric or comprised of multiple stripes in a conventional style. If a trimming is desired, it must be sawn to the existing curtain to result in additional process and increased production cost.

SUMMARY OF THE INVENTION

The primary purpose of the present invention is to provide a new knitting process of a fabric curtain integrated with a trimming. To achieve the purpose, a knitting machine is used to weave for a fabric section in given length in the construction of a preset numbers of warp and weft followed with another section in cable stitch pattern interwoven by warp and weft into multiple braids.

Another purpose of the present invention is to provide a new knitting process of a fabric curtain integrated with a trimming. The trimming comprised of multiple braids is made in a given length for cables gathered in multiple braids in various curvatures to demonstrate diversified and versatile results.

DETAILED DESCRIPTION OF THE PREFERRED EMBODIMENTS

Figure 1:
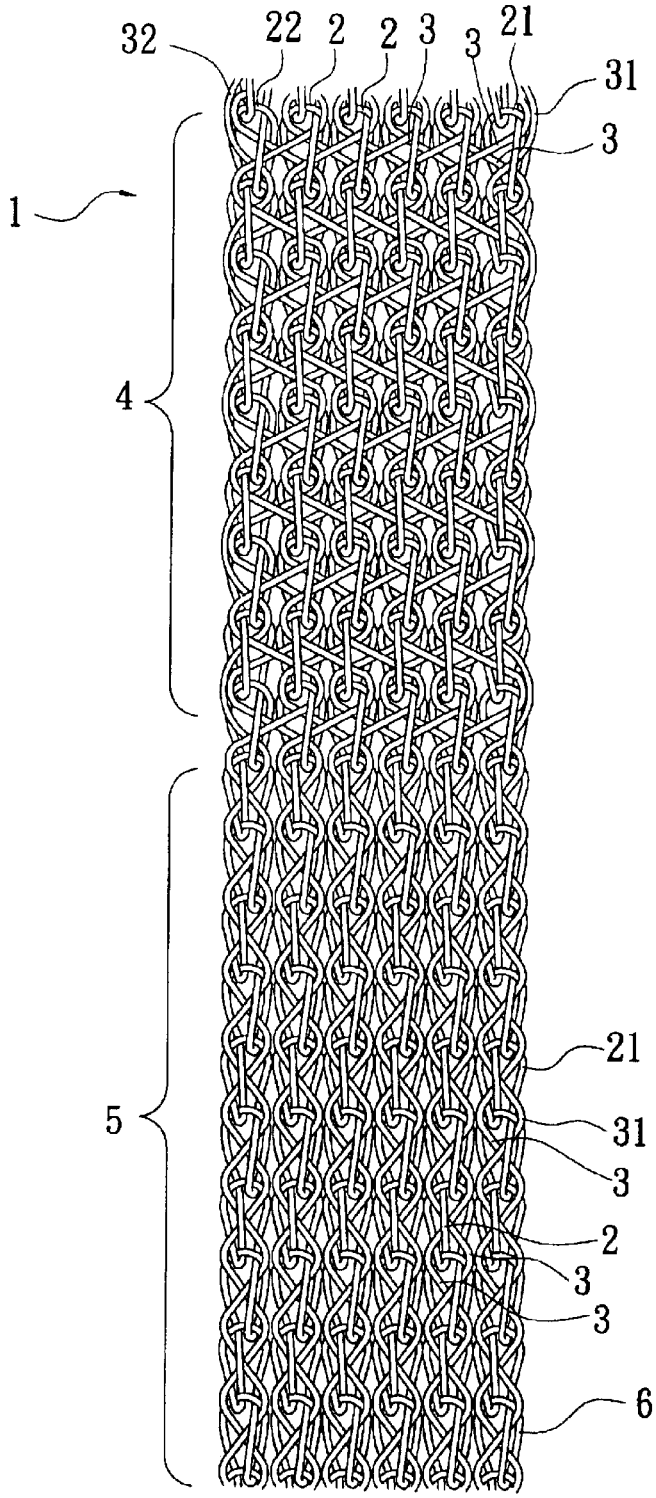
FIG. 1 is a schematic view showing a construction of the present invention.
Figure 3:
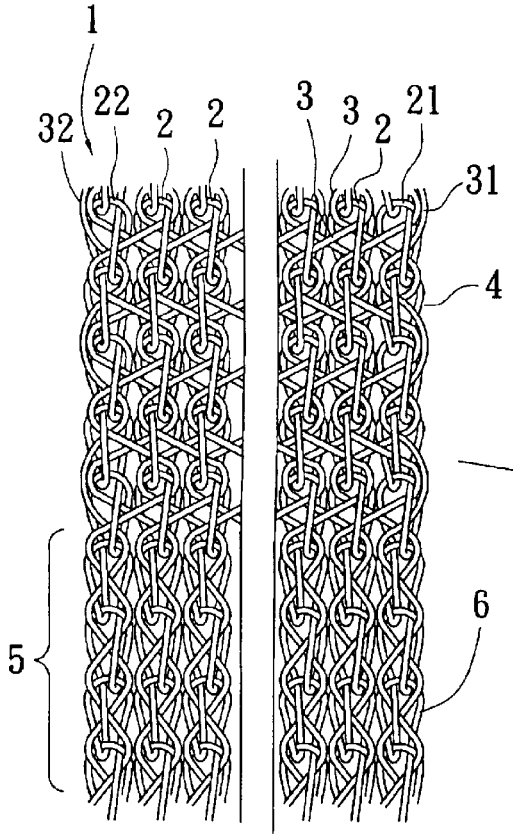
FIG. 3 is a magnified view of a local part of the fragment of the present invention.
Figure 2:
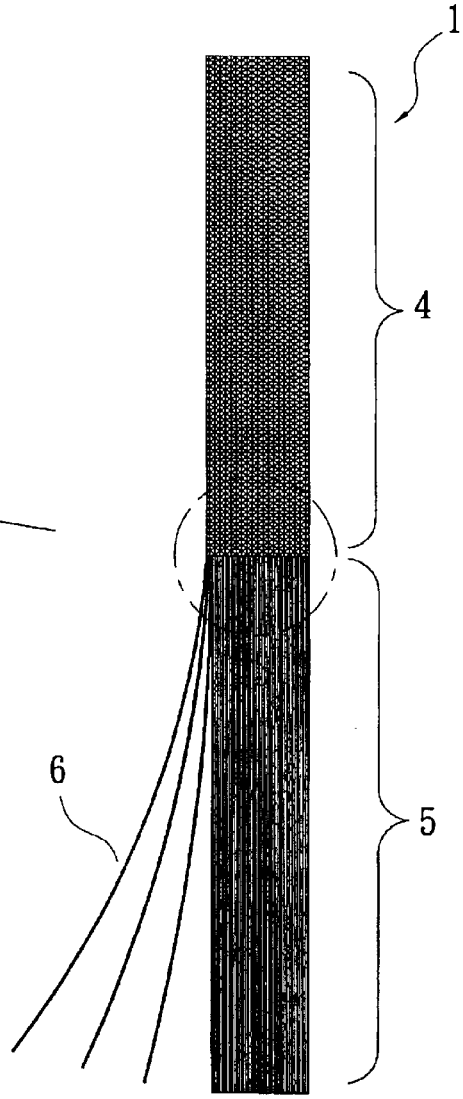
FIG. 2 is a schematic view of a fragment of the present invention.

Referring to FIG. 1 for a construction of a fabric curtain of the present invention, FIG. 2 for a schematic view of having a fabric curtain 1 made into a stripe, and FIG. 3, for a magnified view of the stripe of the fabric curtain 1, the fabric curtain 1 is essentially knitted using a knitting machine by a preset numbers of warp 2 and weft 3 into a primary fabric section 4 in a given length. Within, each warp 2 and weft 3 are interwoven in the cable stitch pattern into a braid 6 and multiple braids 6 form a trimming 5.

Figure 4:
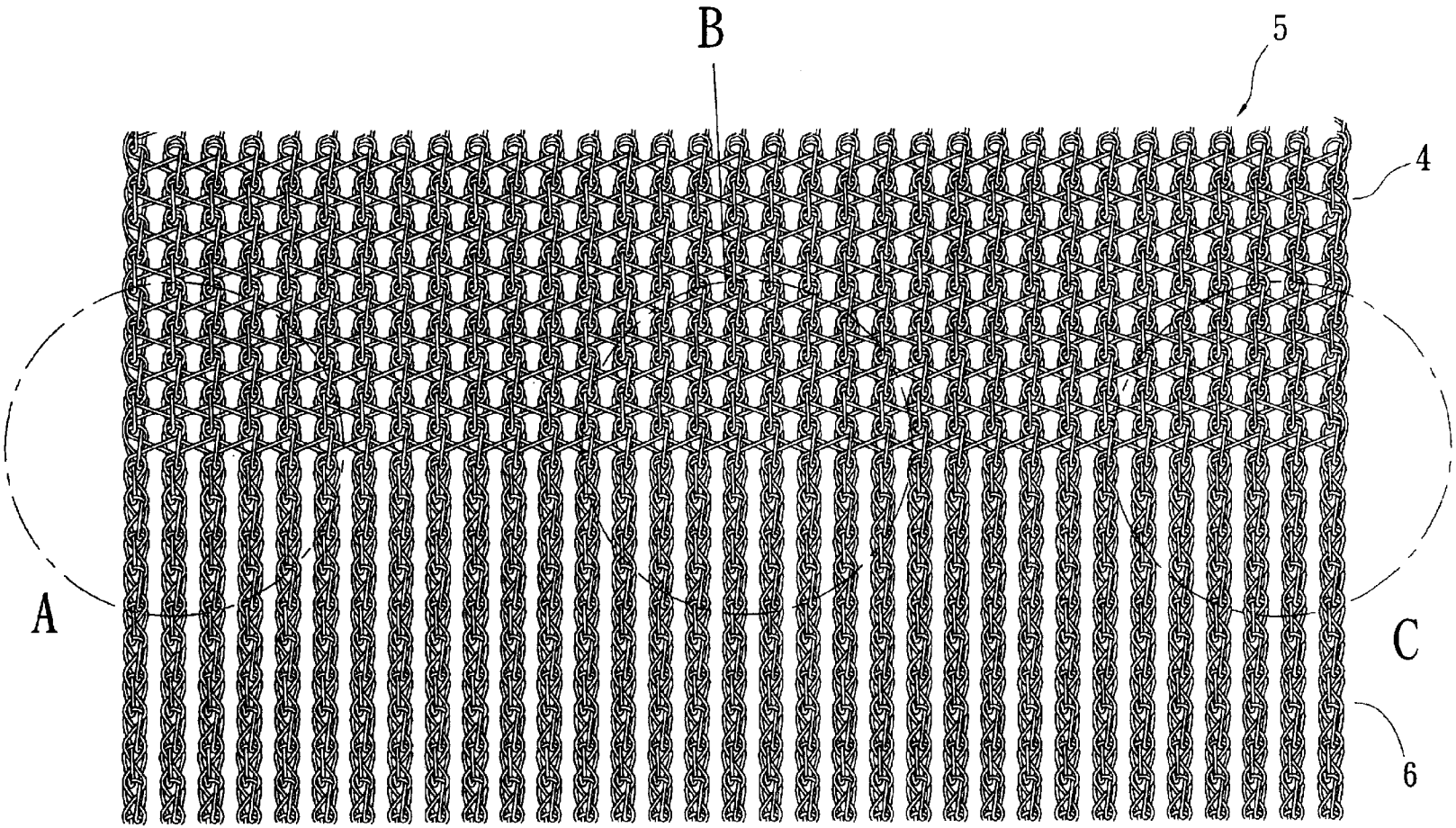
FIG. 4 is a view showing a construction of a fabric curtain of the present invention.
Figure 5:
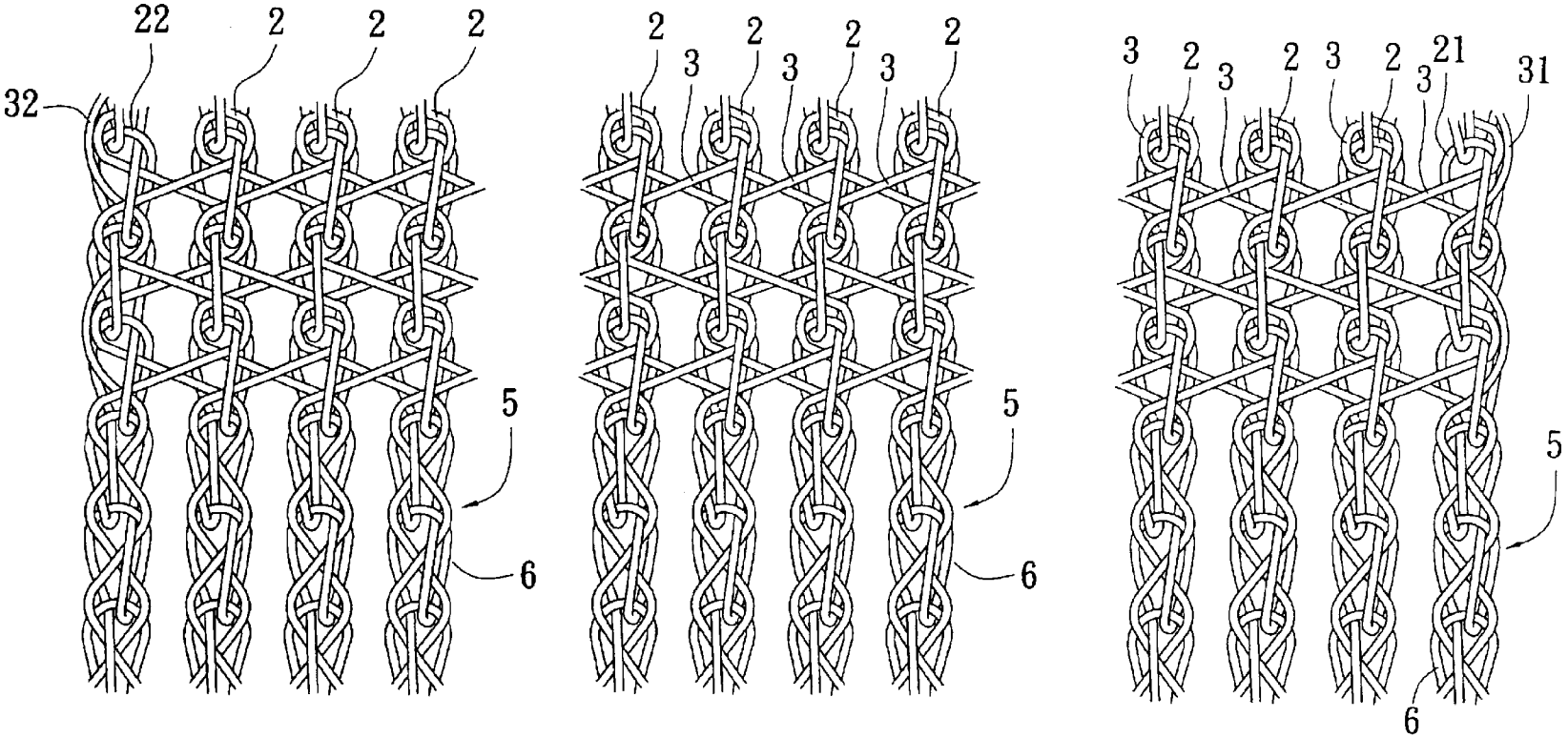
FIG. 5 is a magnified view of a local part taken from FIG. 4.

FIG. 4 shows a construction of a, preferred embodiment of the present invention and FIG. 5 is a magnified view of FIG. 4. As illustrated in FIG. 5, from left to right of the entire curtain, a head area A, a middle area B and a tail area C are respectively circled to show the lateral band area where the fabric section 4 meets the trimming 5.

In the present invention, an ordinary knitting machine and a computerized knitting machine are used. The former is used only for the making of a shorter, and the latter, a longer fabric curtain.

As illustrated in FIGS. 4 and 5, the knitting process of the present invention involves first the preparation of multiple warps 2 longitudinally in parallel and wefts 3 laterally arranged in preset numbers. Firstly, the warps 2 are knitted into multiple loops in series, wherein each warp 2 is respectively knitted with at least two wefts 3 and the first weft 31 and a final weft 32 are knitted from top to bottom in a fashion of the figure "8" into a first warp 21 and a final warp 22. Secondly, those wefts 3 are continuously and alternatively interwoven though those warps 2 either to the right or left until the fabric section 4 in a preset length is attained; finally starting from the bottom of the fabric section 4, those wefts 3 are in sequence knitted by passing through the warps 2 into multiple braids 6 to form the trimming 5 as indicated by those areas A, B, and C in FIG. 5.

Figure 6:
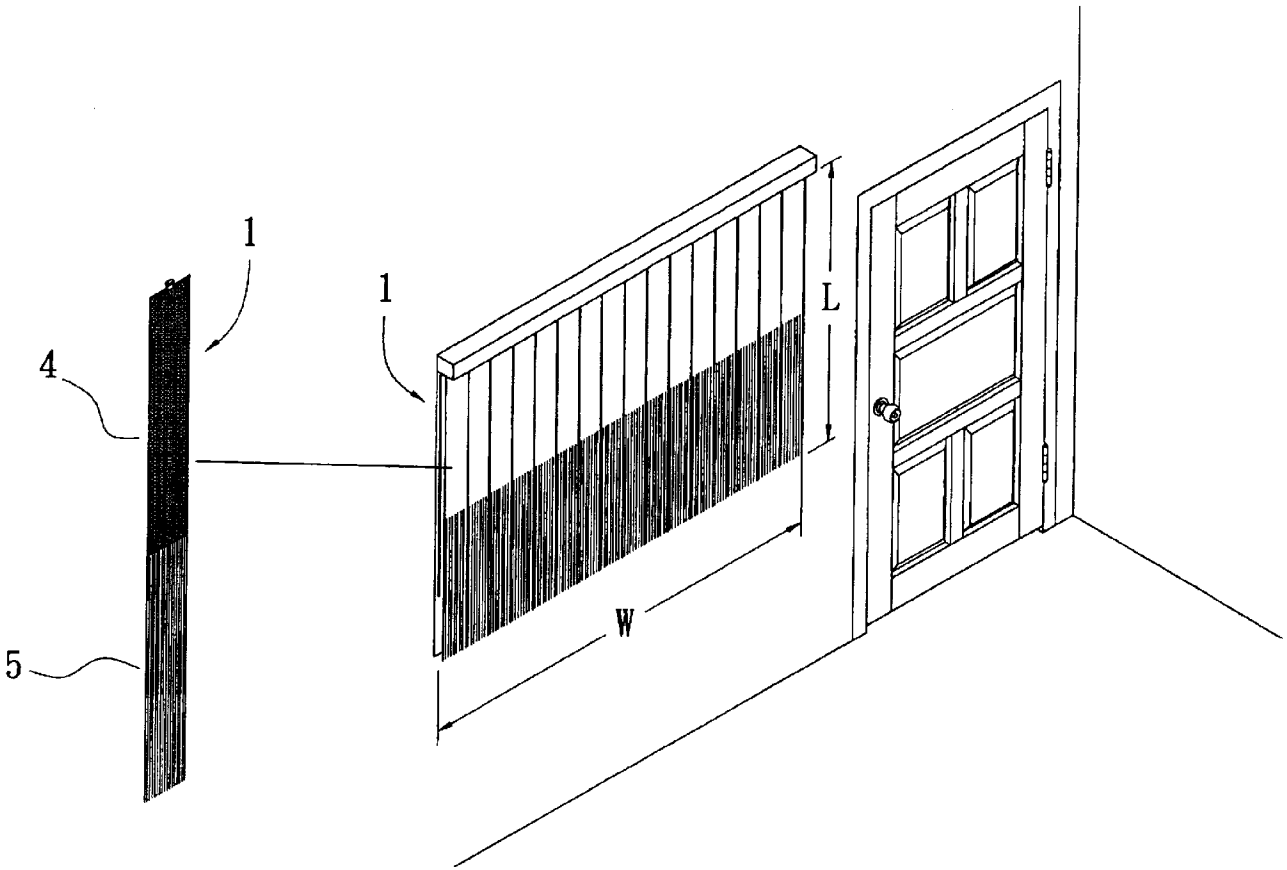
FIG. 6 is a schematic view of a preferred embodiment of the present invention.
Figure 7:
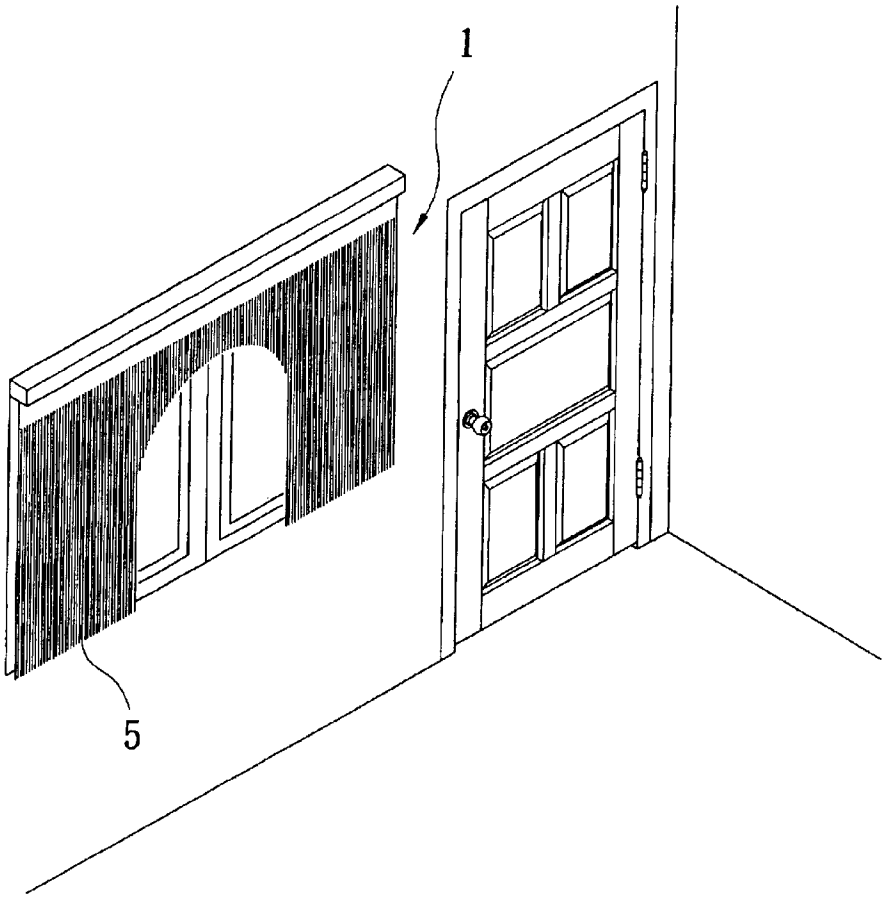
FIG. 7 is a schematic view of another preferred embodiment of the present invention.

Accordingly, the fabric curtain 1 of the present invention is completed. Now referring to FIGS. 6 and 7 for two preferred embodiments of the present invention. For producing the fabric curtain 1 according to customer specification, there is no limits to the width W or the length L of the fabric curtain 1, and the length L of the fabric section 4 or that of the braids 6 may vary as required. Therefore, the style of the fabric curtain 1 can be diversified. For example, those braids 6 may be made into corrugated, flushed, or serrated form. Besides, yarns of different materials may be used for the present invention, namely, natural yarns including cotton, linen, and silk, or synthetic yarns.

As described above, the present invention is not characterized by the fabric section 4; instead, it is characterized by those multiple braids 6 knitted below the fabric section 4. The cable stitch for those braids 6 allows them to given more creative and variable styles for industrial applications. However, it should be noted that those preferred embodiments described above of the present invention does not in any way limit the scope of the present invention. Any equivalent change and/or modification made to that taught in the present invention shall be deemed as falling within the scope of the claims claimed in the present invention.

What is claimed is:

1. A method for knitting a fabric curtain integrated with a trimming comprising the steps of:

utilizing a knitting machine, forming a fabric section comprising the steps of:

knitting a plurality of warps into multiple loops in series;

wherein each of said plurality of warps is knitted with at least two wefts;

knitting a first one of said plurality of wefts and a second one of said plurality of wefts from top to bottom to substantially form a figure 8; and knitting said wefts through said warps in a lateral direction;

utilizing said knitting machine, forming a trimming section continuous with and below said fabric section comprising the step of passing said wefts through said warps to form a plurality of braids.

2. The method of claim 1, wherein, said braids are knitted into one of a corrugated, flushed, and serrated form.

3. The method of claim 1, wherein said warps and said wefts are comprised of one of natural yarn, including cotton, linen, and silk, and synthetic yarn.

* * * * *